US007881637B2

(12) United States Patent
Keilty et al.

(10) Patent No.: US 7,881,637 B2
(45) Date of Patent: Feb. 1, 2011

(54) METHOD AND APPARATUS FOR CONTROLLING MULTIPLE COLOR DEVELOPERS USING A CAMMING MECHANISM

(75) Inventors: Peter John Keilty, Welwyn Garden (GB); Andrew Edward Taylor, Hitchin (GB); Roger Derek Masham, Ashwell (GB); Jeremy Brook Lewis, Golders Green (GB)

(73) Assignee: Xerox Corporation, Norwalk, CT (US)

( * ) Notice: Subject to any disclaimer, the term of this patent is extended or adjusted under 35 U.S.C. 154(b) by 730 days.

(21) Appl. No.: 11/778,918

(22) Filed: Jul. 17, 2007

(65) Prior Publication Data

US 2009/0022521 A1 Jan. 22, 2009

(51) Int. Cl.
*G03G 15/01* (2006.01)

(52) U.S. Cl. ..... 399/228

(58) Field of Classification Search ..... 399/223, 399/228

See application file for complete search history.

(56) References Cited

U.S. PATENT DOCUMENTS 6,694,118 B2 * 2/2004 Yoo ..... 399/228
7,177,575 B2 * 2/2007 Okabe ..... 399/228

* cited by examiner

*Primary Examiner*—William J Royer
(74) *Attorney, Agent, or Firm*—Oliff & Berridge, PLC

(57) ABSTRACT

Aspects of this disclosure describe a multi-pass printer having a photoreceptor device mounted on an axis, a developer that is arranged adjacent to the photoreceptor device and is movable between a first position and a second position, and a camming mechanism mounted on the axis that acts upon the developer to urge the developer between the first and second positions. The camming mechanism can further include a camming disc that is mounted to rotate about the axis. The camming disc can also have an outer periphery edge having a first portion defined by a first radius and a second portion defined by a second radius. The camming mechanism can also have a developer roll spacing cam having an effective radius that maintains a spacing between the developer and the photoreceptor device.

16 Claims, 3 Drawing Sheets

METHOD AND APPARATUS FOR CONTROLLING MULTIPLE COLOR DEVELOPERS USING A CAMMING MECHANISM

BACKGROUND

Printing systems are complex and can include numerous components that work cooperatively to form an image. Each printer component can perform a specific function that enables the printing system to produce the desired image. For example, a printing system can generally include a photoreceptor device, such as a drum or a belt. During operation, a charging device can act upon a photoreceptor surface to charge the photoreceptor surface uniformly. Subsequently, an exposing device can act on the photoreceptor surface to selectively dissipate the charge on the photoreceptor surface to record an electrostatic latent image. A developing device (usually called developer) can then act on the photoreceptor surface to develop the latent image into a toner image.

In order to produce a multi-color image, the described operation can happen multiple times. Each time, the photoreceptor surface can sequentially pass the charging device, exposing device and developers. During each pass, after being charged uniformly by the charging device, the photoreceptor surface can be exposed to generate the electrostatic latent image, then one developer can be chosen to apply toner particles of one color to the electrostatic latent image on the surface of the photoreceptor device to form a toner image of one color. Multiple passes are needed to form toner images of different colors. The toner images of different colors are then placed together in a state of superimposed registration with one another to form the multi-color toner image. The multi-color toner image can then be transferred to a sheet of substrate and fused onto the substrate.

Multi-color printing systems can require multiple developers. When one developer is in working status to apply toner particles to a latent image, the other developers need to be put into non-working status so that they will have no effect on the current specific latent image or have no effect on the developer that is working to avoid color intermingling. When a latent image requires another developer to apply different toner particles, the previous developer needs to be switched to non-working status so that it will have no effect on the current latent image. Therefore, during printing, it can become necessary to switch the status of each developer. The status switching generally involves movement of numerous components within the printing system. Such movements can introduce transient force to the printing system, and thus decrease image quality.

SUMMARY

This disclosure is directed to a printing system, in particular a camming method for switching developers in a printing system, such as a multi-pass printing system.

A camming mechanism of the present disclosure allows printing systems to execute print jobs by selectively moving developers into and out of an operational contact with a photoreceptor device. Further, each developer can include a camming mechanism, which enables each developer to be independently controlled to move into or out of operational contact with the photoreceptor device.

An embodiment can include a multi-pass printer having a photoreceptor device mounted on an axis, a developer that is arranged adjacent to the photoreceptor device and is movable between a first position and a second position, and a camming mechanism mounted on the axis that acts upon the developer to urge the developer between the first and second positions. The camming mechanism can further include a camming disc that is mounted to rotate about the axis. The camming disc can also include an outer periphery edge having a first portion defined by a first radius and a second portion defined by a second radius. The camming mechanism can also have a developer roll spacing cam having an effective radius that maintains a spacing between the developer and the photoreceptor device.

In an embodiment of the multi-pass printer, the developer can further include a cam follower that contacts the outer periphery edge of the camming disc so that the developer can be urged to the first position when the first portion of the outer periphery edge having the first radius is in contact with the cam follower, and the developer can be urged to the second position when the second portion of the outer periphery edge having the second radius is in contact with the cam follower.

In one embodiment, the developer may also have a spacing cam follower that can come into contact with the developer roll spacing cam while the cam follower is in contact with the first portion of the outer periphery edge having the first radius of the camming disc so as to maintain the spacing between the developer and the photoreceptor device.

Another embodiment includes a multi-pass printer having at least two developers that are arranged adjacent to a photoreceptor device and each is movable between a respective first position and a respective second position, and a camming mechanism individually acts upon the developers to urge the developers between the first and second positions. The camming mechanism can include a plurality of camming discs corresponding to the developers that are mounted to rotate about the axis. The camming discs can have respective outer periphery edges having a first portion and a second portion having different radii. The camming mechanism can have a developer roll spacing cam having an effective radius that maintains a spacing between the developers and the photoreceptor device.

In the multiple developer multi-pass printer, each of the developers can also have a cam follower that contacts the outer periphery edge of a camming disc corresponding to the particular developer so that the developer can be urged to the first position when the first portion of the outer periphery edge is in contact with the cam follower, and the particular developer can be urged to the second position when the second portion of the outer periphery edge is in contact with the cam follower. Each of the developers can include a spacing cam follower that comes into contact with the developer roll spacing cam while the cam follower of the respective developer is in contact with the first portion of the outer periphery edge of the camming disc so as to maintain the spacing between the respective developer and the photoreceptor device.

During operation of the multi-pass printer, the respective developer can be in an operational contact with the photoreceptor device while in the first position, and the respective developer is in non-operational contact with the photoreceptor device while in the second position. The camming mechanism can urge a first developer to be in operational contact with the photoreceptor device while the camming mechanism urges a second developer to be in non-operational contact with the photoreceptor device, and vice-versa.

The camming mechanism and camming apparatus can use low cost components thus cost effectively allow the switching of developer with minimal impact to the motion quality in the color printing system, thereby improving the image quality in a cost efficient way.

The present disclosure can provide a method and an apparatus that operate on the camming mechanism to maintain almost constant force during the status switching of the developers. By this technique, transient force can be minimized, and image quality can be improved.

BRIEF DESCRIPTION OF THE DRAWINGS

Various exemplary embodiments of this disclosure will be described in detail with reference to the following figures, wherein like numerals reference like elements and wherein.

EMBODIMENTS

For a general understanding of the features of the present disclosure, reference is made to the drawings of a xerographic multi-pass printer as a specific type of multi-pass system for the sake of clarity, familiarity, and ease of description. However, it should be appreciated that the method and apparatus disclosed herein, as discussed below, can be equally applied to any known or later-developed multi-pass systems.

Figure 1:
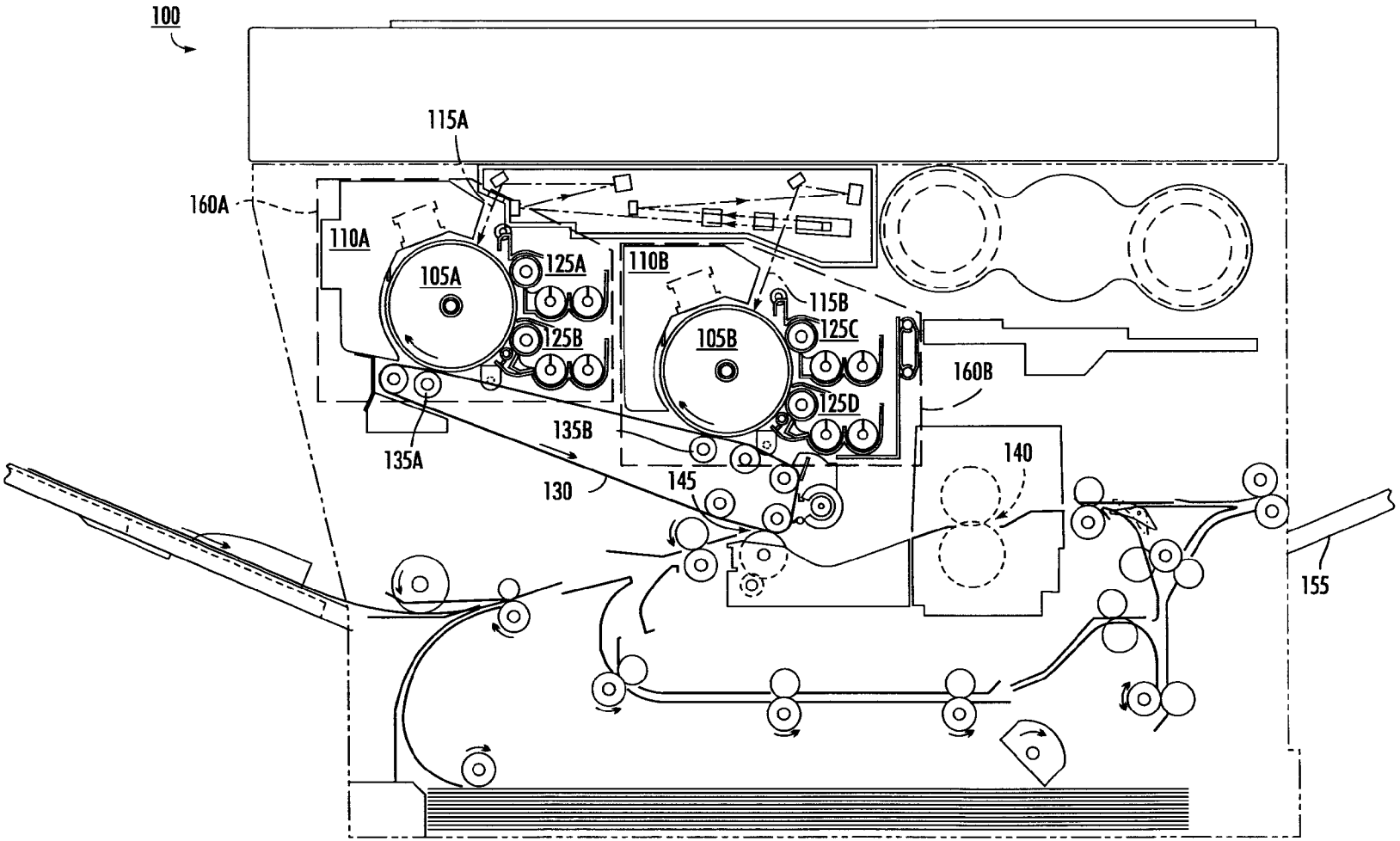
FIG. 1 is a diagram showing an exemplary configuration of a multi-pass color printer.

FIG. 1 illustrates an exemplary configuration for a multi-pass color printing system 100. This multi-pass printing system 100 can include components that support creating desired images, such as a photoreceptor device, charging device, exposing device, developer, transferring device, and fusing device, as well as a feeding device and finishing device.

A xerographic printer can employ at least one photoreceptor device, typically in the form of a drum or a belt. In FIG. 1, the multi-pass printing system 100 has two photoreceptor devices 105A and 105B in the form of photoreceptor drums. Initially, a photoreceptor surface of a photoreceptor device can be electro-statically charged to a uniform potential. Then an exposing device can dissipate the charges on the photoreceptor device according to a desired image to produce an electrostatic latent image on the photoreceptor device. Subsequently a developer can apply toner particles to the photoreceptor surface of the photoreceptor device. According to the electrostatic potential on the photoreceptor surface, toner particles are adhered to the photoreceptor surface to generate a toner image.

The xerographic printer can include at least one charging device. In FIG. 1, the multi-pass printing system 100 has two charging devices 110A and 110B. Normally the photoreceptor device 105A and 105B is cleaned to remove any residue toner particles before charging. The charging device 110A and 110B can produce electric fields to charge the surface of the photoreceptor device 105A and 105B, such as the surface of the photoreceptor drum. Charge uniformity is desirable.

The xerographic printer can include at least one exposing device. In the exposing device, a light beam can emit from light emitting devices, such as semiconductor laser devices. The light beam can pass through an optical system, scan the surface of photoreceptor device 105A and 105B such as the photoreceptor drum. In FIG. 1, the multi-pass printing system 100 has two light beams 115A and 115B. The intensity of the light beam at each point is corresponding to color density of one of the primary colors (e.g., cyan, magenta, yellow and black) needed to appear in the desired image at that point. After the exposing process, an electrostatic image can be generated on the surface of the photoreceptor device 105A and 105B.

The xerographic printer can also include at least one developer. In the exemplary color printing system shown in FIG. 1, it includes four developers 125A, 125B, 125C and 125D. For multi-color print, the xerographic printer can use different colors in different developers. For example, developer 125A can use cyan, developer 125B can use black, developer 125C can use yellow, and developer 125D can use magenta. During the developing process, development material such as toner particles can be brought into contact with the latent image to form the toner image. Since one latent image on the photoreceptor surface is related to one color, during the development of this latent image, only one developer needs to be in operational contact with the photoreceptor surface. Meanwhile the other developers need to be put in non-operational contact, so that they do not affect this specific latent image.

One technique to perform this function is by controlling the distance of the developer to the photoreceptor surface. During the development of one latent image, a corresponding developer is moved into operational contact with the photoreceptor surface such that the developer is close to the photoreceptor surface, however usually not touching the surface. The distance needs to be small enough for this corresponding developer to apply development material, such as toner particles, to the photoreceptor surface to form the toner image. The other developers are in positions away from the photoreceptor surface so that they do not interfere with the development of this specific latent image.

While a xerographic printer generally includes at least one photoreceptor device, at least one charging device, at least one exposing beam, and at least one developer, the exemplary printing system in the FIG. 1 has two photoreceptor drums 105A and 105B, two charging devices 110A and 110B, two exposing beams 115A and 115B, and four developers 125A, 125B, 125C and 125D. Two separate units can be arranged and are enclosed in the box 160A and 160B, respectively. Each of the units can include a photoreceptor drum, a charging device, an exposing light beam, and two developers. Each of the units is capable of working independently to generate a toner image on the surface of the respective photoreceptor drum.

The xerographic printer may also include an intermediate transfer belt and associated transfer devices depending on the type of the engine. The multi-pass printing system in FIG. 1 has one intermediate transfer belt 130 and associated transfer device 135A and 135B. The toner image on the surface of the photoreceptor device 105A and 105B can be primarily transferred onto the intermediate transfer belt 130 by the transfer device 135A and 135B one at a time. The toner images of multiple colors can be put together on the intermediate transfer belt 130 in such a way that they are in the state of superimposed registration with each other.

The xerographic printer can also include at least one transferring device that is responsible for transferring toner image to a sheet of substrate, such as a piece of paper. In FIG. 1, transferring device 145 is composed of rolls that can execute this function.

The xerographic printer can also include at least one fusing device that is responsible for permanently fusing the superimposed multiple color toner image to the sheet of substrate, such as a piece of paper. In FIG. 1, fusing device 140 is such kind of device.

The xerographic printer can also include various sensors, controllers, and motors. The sensors can sense the status of the components of the engine such as position, color, speed and the like, then relay the information to the controllers. The controllers can decide the movements of the components of the printer, such as moving into or moving out of a position. The controllers can give signals to the motors to drive the components in the desired motions.

The exemplary printing system in FIG. 1 can be used to illustrate an exemplary color printing process of a multi-pass printing system. At the beginning of the process, the surface of the photoreceptor drum 105A can turn to the cleaning and charging device 110A. Residual toner particles from previous passes can be removed and the surface can be charged uniformly. Then the charged surface of photoreceptor drum can turn to the exposing light beam 115A. According to the density of one primary color, for example the cyan, the exposing light beam 115A can scan the surface of the photoreceptor drum 105A so that a latent image can be formed on the photoreceptor drum surface. In the example of color cyan that is associated with the latent image, the developer 125A which has toner particles of color cyan may need to be put in working status in order to develop the latent image. So developer 125A can be moved into operational contact with the photoreceptor drum 105A. And the developer 125B with toner particles of color black needs to be kept away from the photoreceptor drum 105A, thus the developer 125B is kept at a distance or in non-operational contact with the photoreceptor drum 105A. After the development by developer 125A, toner image of cyan can be formed on the surface of the photoreceptor drum 105A. Finally, the toner image of color cyan can be transferred to the intermediate transfer belt 130 by the transferring device 135A. The photoreceptor drum 105A can then turn to the cleaning and charging device 110A to prepare its surface for a next pass.

For easy illustration, an assumption can be made that the color of the next toner image that needs to be formed is black. After the surface of the photoreceptor drum 105A passes the cleaning and charging device 110A again, the photoreceptor drum 105A can be charged uniformly. Then the charged surface of photoreceptor drum 105A can turn to the exposing light beam 115A. According to the density of black on each point of the desired image, the light beam 115A can expose the surface of the photoreceptor drum 105A. After the exposing process, a latent image is form on the surface of the photoreceptor drum 105A. In the example, the latent image is associated with color black. The developer 125B with toner particles of color black needs to be put in working status to develop the latent image. So developer 125B is moved into operational contact with the photoreceptor drum 105A surface. And the developer 125A with toner particles of color cyan is kept at a distance or in non-operational contact with the photoreceptor drum 105A. After development, toner image of color black is formed on the photoreceptor drum 105A. Finally, the surface of photoreceptor drum 105A can turn to the intermediate transfer belt 130 again. The transferring device 135A can transfer the toner image on the surface of the photoreceptor drum 105A to the intermediate transfer belt 130. The sensors, controllers and the motors can work cooperatively to let the toner image of color black be superimposed registered with the toner image of cyan on the intermediate transfer belt 130 from the previous pass.

Photoreceptor drum 105B can work the same way as 105A, but with a separate charging device 110B, a separate exposing light beam 115B and two separate developers 125C and 125D. In the example, developer 125C contains yellow toner, and developer 125D contains magenta toner, toner image of yellow or toner image of magenta can be formed on the surface of photoreceptor drum 105B after a pass of development. The toner image on the surface of the photoreceptor drum 105B can then be transferred by the transferring device 135B to the intermediate transfer belt 130. The sensors, controllers and the motors can ensure that this toner image is superimposed registered with the toner image that already exists on the intermediate transfer belt 130 from the previous passes of photoreceptor drum 105A.

After all the predetermined toner images have been transferred onto the intermediate transfer belt 130 in the state of superimposed registration with one another, a multi-color toner image on the intermediate transfer belt 130 can be transferred to a sheet of substrate through the transferring device 145 on the FIG. 1.

The sheet of substrate can pass through the fusing device 140 to get the multi-color toner image permanently fused on the substrate. Finally the sheet of substrate can go to the finishing device 155.

One latent image on the surface of the photoreceptor drum 105A and 105B can be developed by one of the plurality of developers 125A, 125B, 125C and 125D that is associated with the photoreceptor drum 105A and 105B. For example, in FIG. 1 the latent image on the surface of photoreceptor 105A can be developed by either 125A or 125B, depending on the color requirement. A switching mechanism is needed to switch amongst the developers 125A and 125B according to the color association of the latent image. Generally switching involves movements of components in the xerographic printer which may introduce transient force into the xerographic printer, and thus distort the image.

In an embodiment of the disclosure, a camming mechanism can be employed to move the developers into or out of operational contact with the photoreceptor drum. Such camming mechanism can be low cost and useful in minimizing any transient force, and thus improve image quality.

Figure 2A:
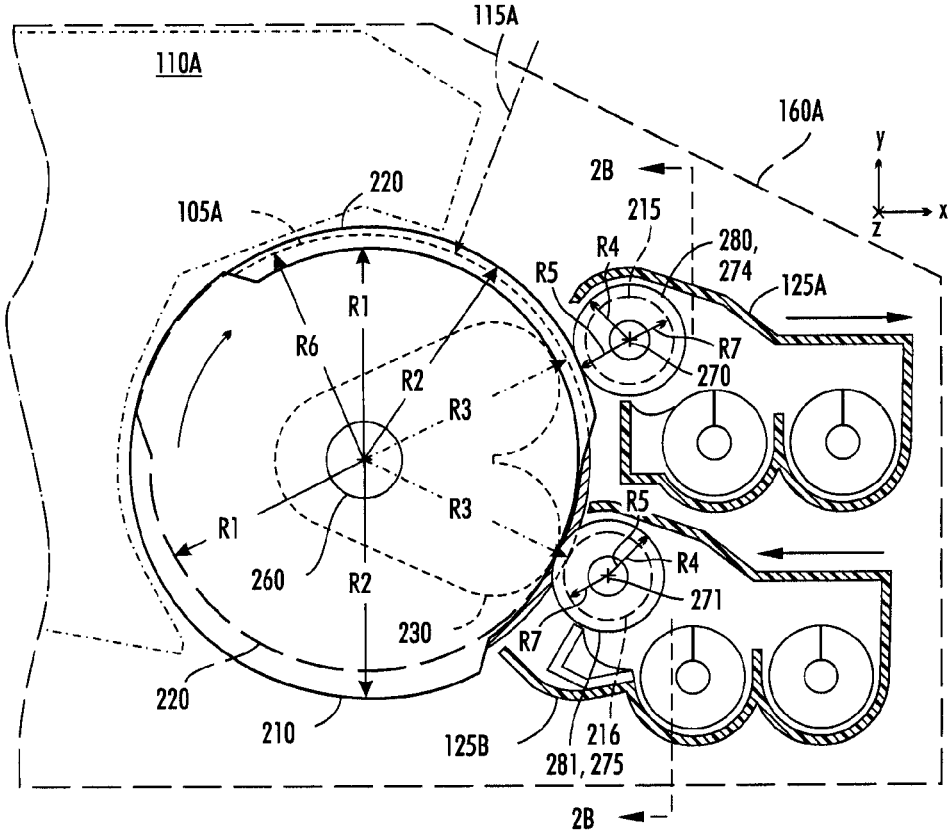
FIG. 2A and FIG. 2B are diagrams showing different views of an exemplary camming mechanism.
Figure 2B:
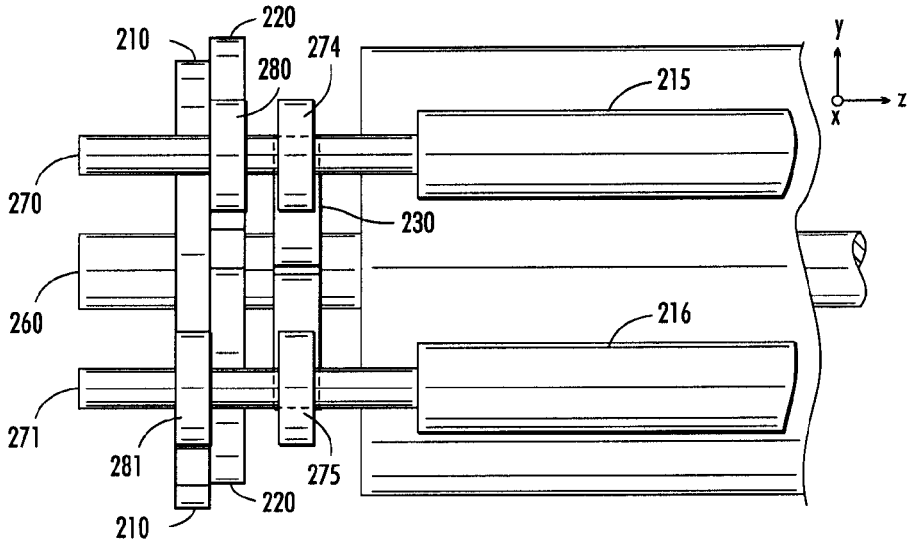

FIG. 2A and. FIG. 2B are diagrams showing views of an exemplary camming mechanism in the present disclosure. FIG. 2A is a view into the Z direction, the viewing direction is the same as FIG. 1. FIG. 2B is a view into the negative X direction. The camming mechanism can include components arranged with a photoreceptor drum and components arranged with a developer.

FIG. 2A and FIG. 2B show side views of a photoreceptor drum 105A that is rotatable mounted on a photoreceptor drum shaft 260. In the exemplary embodiment shown, there are two cam discs 210 and 220 arranged at one end of the photoreceptor drum shaft 260. Not shown in the diagram, there can be another set of cam discs 210 and 220 at the other end of the photoreceptor drum shaft 260. Cam discs 210 and 220 can be mounted co-axially with photoreceptor drum shaft 260. The cam discs 210 and 220 are designed in such a way that a radius from the outer periphery edge to the center is not always equal. For example, a portion of a cam disc can have smaller radius R1 indicated in FIG. 2A. Radius R1 may not necessarily be the minimum radius. Additionally, a portion of the outer periphery edge of the cam disc can have larger radius R2 indicated in FIG. 2A. Radius R2 may not necessarily be the maximum radius of the cam disc. Further, the radii R1 and R2 for the various cam disc need not be the same from disc to disc. In operation, the cam disc 210 and 220 can be rotated about the photoreceptor drum shaft 260 and can cause the portion of the outer periphery edge having different radius to act upon the developers 125A and 125B to urge the developers 125A and 125B between a first and a second position. The cam disc 210 can actuate the movement of developer 125B. The cam disc 220 can actuate the movement of developer 125A. The cam disc 210 can move independently of the cam disc 220. Separate motors may be used to drive those cam discs 210 and 220 separately.

In the exemplary embodiment, in addition to the cam discs 210 and 220, there can be at least one other cam disc called developer roll spacing cam 230 that may also be coaxially arranged on the photoreceptor drum shaft 260. The effective radius of the developer roll spacing disc is R3. The developer roll spacing cam 230 can be kept stationary during a developing process. Together with the other cam discs 210 and 220, the developer roll spacing cam 230 can maintain a desired distance between the surface of the photoreceptor drum 105A and the surface of the developer 125A and 125B while the developer 125A and 125B is in operational contact with the photoreceptor surface. On one side, the distance prevents the surface of the photoreceptor drum surface touching the developer 125A and 125B. On the other side, the distance is short enough for the developer to apply development material, such as toner particles to the surface of the photoreceptor drum 105A.

From the developer side, each developer 125A and 125B can have a developer roll shaft 270. At the end of each developer roll shaft 270, for example, there can be arranged at least one cam follower. In the exemplary embodiment shown in FIG. 2B, there are two cam followers 274, 280 on the developer roll shaft 270 and two cam followers 275, 281 on developer roll shaft 271. They are mounted co-axially on the respective developer roll shafts 270, 271. One cam follower 274 in FIG. 2B is at the same Z location as the developer roll spacing cam 230, the radius of the cam follower 274 is R5 in FIG. 2A. The other cam follower 280 is at the same Z location as the corresponding cam disc 220.

The radius of the photoreceptor drum 105A is R6 shown in FIG. 2A, and the radii of the developer rolls 215 and 216 are R7 shown in the FIG. 2A.

In this present disclosure, each of the cam discs 210 or 220 can independently control the status of one developer 125A or 125B. For example, cam disc 210 controls the status of developer 125B and cam disc 220 controls the status of developer 125A.

In the present disclosure, each developer 125A or 125B is associated to the photoreceptor drum 105A through a respective slide (not shown) that guides the movement of the developer 125A and 125B. The slide can be connected to a side plate that supports the photoreceptor drum 105A. If the slide is parallel to the X direction, the developer 125A and 125B can then be moved along the slide, for example in the X direction, into and out of the operational contact with the photoreceptor drum 105A. In the exemplary embodiment, one or more springs (not shown) can engage the developer 125A and 125B to urge the components of the camming mechanism arranged on the developer 125A and 125B to be in contact with the components of the camming mechanism on the photoreceptor drum 105A. By this approach, there is an almost uniform spring load on the photoreceptor drum shaft 260 through the camming mechanism independent of the developer position.

When a cam disc on the photoreceptor drum turns, the portion of the outer periphery edge with larger radius and the portion of the outer periphery edge with smaller radius alternatively in contact with a cam follower of the same Z location on the developer roll shaft. Then at least there are two different distance relationship of the photoreceptor drum surface and the developer roll surface.

When the portion of the outer periphery edge with larger radius gets in contact with the cam follower. The distance between the photoreceptor drum surface and the developer roll surface can be represented as equation 1:

$$R_{P\text{-}D}=R2+R4-R6-R7 \quad (1)$$

R2 can be adjusted such that the developer is far enough from the surface of the photoreceptor drum, so the developer is in non-working status.

When the portion with smaller radius gets in contact with the circular disc, without considering the developing roll spacing disc 230, the distance between the photoreceptor drum surface and the developer roll surface can be represented as equation 2:

$$R_{P\text{-}D}=R1+R4-R6-R7 \quad (2)$$

The smaller radius of the cam disc R1 is usually equal or smaller than the effective radius R3 of the developing roll spacing cam 230. Thus, the developing roll spacing cam 230 is actuated. The distance between the photoreceptor drum surface and the developer roll surface is then determined by equation 3.

$$R_{P\text{-}D}=R3+R4-R6-R7 \quad (3)$$

R3 can be fixed in such a way that the developer is close to the surface of the photoreceptor drum that it can effectively apply toner particles to the latent image on the photoreceptor drum surface. Then this developer is in operational contact with the photoreceptor drum.

By adjusting the radii of the cam discs arranged on the photoreceptor device and the cam followers arranged on the developer side, a first position and a second position of a developer can be defined. When the developer is at the first position, the developer can effectively apply toner particles to the surface of the photoreceptor to generate the toner image. When the developer is at the second position, the developer is far enough from the surface of the photoreceptor drum that it can not interfere with the possible developing process. As described above, the cam disc can be turned to urge the developer into the first position or into the second position.

Figure 3:
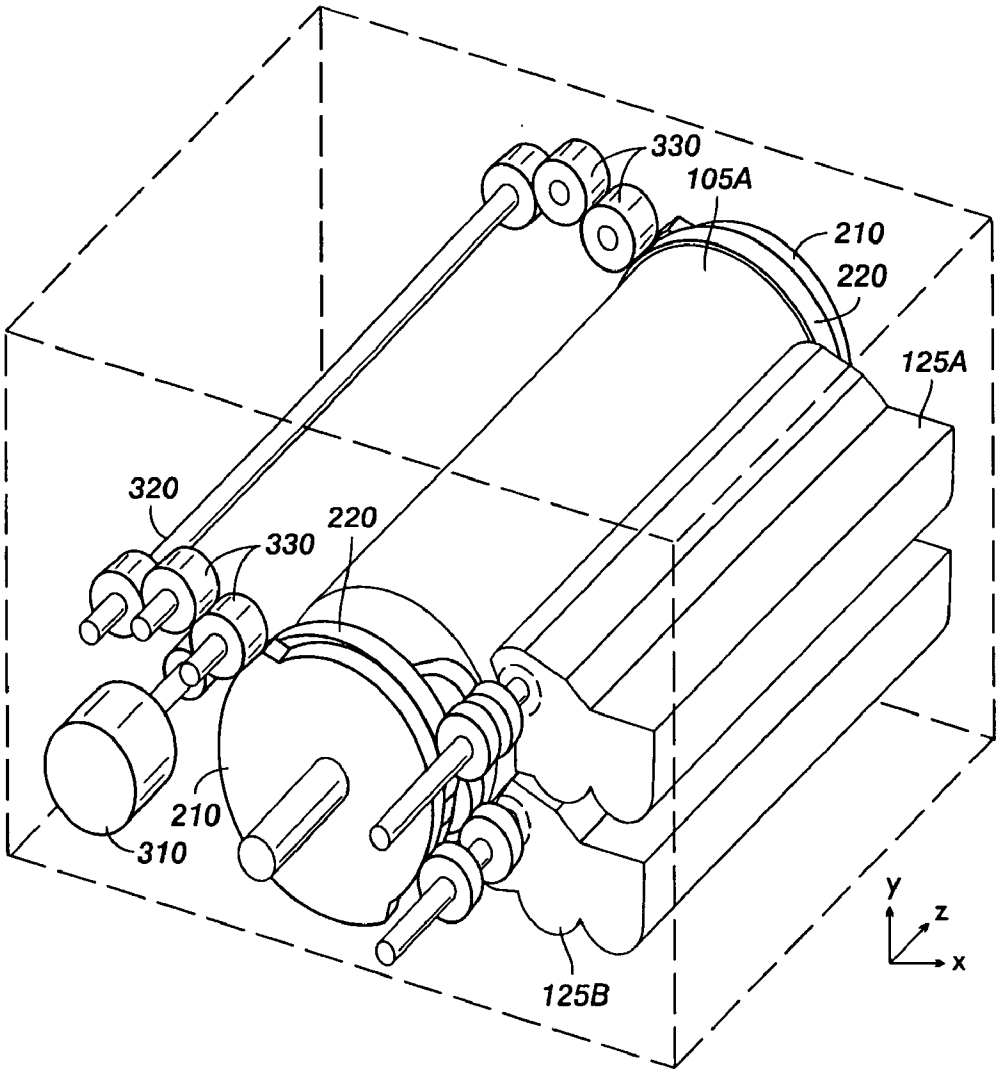
FIG. 3 is a diagram showing an isometric view of an exemplary camming mechanism.

As shown in the exemplary printing system of FIG. 1, two developers can be associated with one photoreceptor drum through slides to compose a xerographic replaceable unit (XRU). XRU can be replaced by the operator of the system. FIG. 3 is the diagram showing an isometric view of an XRU in a drawer of a printing system. Also shown in FIG. 3, cam drive 310 can be used to drive the cam discs through numerous transfer rolls 330 and transfer shaft 320. Other driving approaches can include using separate motors instead of the transfer shaft 320, so each cam disc can be driven independently.

It will be appreciated that variations of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A multi-pass printer comprising:

a photoreceptor device mounted on an axis;

at least two developers that are arranged adjacent to the photoreceptor device, and each developer being movable between a respective first position and a respective second position;

a camming mechanism mounted on the axis that individually acts upon the developers to urge the developers between the respective first and second positions, wherein the camming mechanism further includes a plurality of camming discs corresponding to the developers that are mounted to rotate about the axis.

2. The multi-pass printer according to claim 1, wherein the camming disc includes an outer periphery edge having a first portion defined by a first radius and a second portion defined by a second radius.

3. The multi-pass printer according to claim 2, the developers further comprising:

a cam follower that contacts the outer periphery edge of the camming disc so that the developers are urged to the first position when the first portion of the outer periphery edge having the first radius is in contact with the cam follower, and the developer is urged to the second position when the second portion of the outer periphery edge having the second radius is in contact with the cam follower.

4. The multi-pass printer according to claim 1, the camming mechanism further comprising:

a developer roll spacing cam having an effective radius that maintains a spacing between the developers and the photoreceptor device.

5. The multi-pass printer according to claim 4, the developers further comprising:

a spacing cam follower that comes into contact with the developer roll spacing cam while the spacing cam follower is in contact with a first portion of an outer periphery edge having a first radius of the camming disc so as to maintain the spacing between the developers and the photoreceptor device.

6. The multi-pass printer according to claim 1, wherein the camming discs include respective outer periphery edges having a first portion and a second portion having different radii.

7. The multi-pass printer according to claim 6, each of the developers further comprising:

a cam follower that contacts the outer periphery edge of a camming disc corresponding to the particular developer so that the developer is urged to the first position when the first portion of the outer periphery edge is in contact with the cam follower, and the particular developer is urged to the second position when the second portion of the outer periphery edge is in contact with the cam follower.

8. The multi-pass printer according to claim 7, the camming mechanism further comprising:

a developer roll spacing cam having an effective radius that maintains a spacing between the developers and the photoreceptor device.

9. The multi-pass printer according to claim 8, each of the developers further comprising:

a spacing cam follower that comes into contact with the developer roll spacing cam while the cam follower of the respective developer is in contact with the first portion of the outer periphery edge of the camming disc so as to maintain the spacing between the respective developer and the photoreceptor device.

10. The multi-pass printer according to claim 7, wherein the respective developer is in an operational contact with the photoreceptor device while in the first position, and the respective developer is in non-operational contact with the photoreceptor device while in the second position.

11. The multi-pass printer according to claim 10, wherein the camming mechanism urges a first developer to be in operational contact with the photoreceptor device and the camming mechanism urges a second developer to be in non-operational contact with the photoreceptor device.

12. The multi-pass printer according to claim 1, wherein a respective developer of the at least two developers is in an operational contact with the photoreceptor device while in the first position, and the respective developer is in non-operational contact with the photoreceptor device while in the second position.

13. The multi-pass printer according to claim 12, wherein while the camming mechanism urges a first developer of the at least two developers to be in operational contact with the photoreceptor device, the camming mechanism urges a second developer of the at least two developers to be in non-operational contact with the photoreceptor device.

14. A method for operating a multi-pass printer having a photoreceptor drum, a plurality of developers and a camming mechanism, comprising:

operating the camming mechanism to urge a first developer to a first position while urging other developers to a second position relative to the photoreceptor drum;

developing a first image on the photoreceptor drum with the first developer;

operating the camming mechanism to urge a second developer to the first position while urging other developers to the second position relative to the photoreceptor drum;

developing a second image on the photoreceptor drum with the second developer;

driving a first camming disc in the camming mechanism via a first motor; and driving a second camming disc in the camming mechanism via a second motor.

15. The method for operating a multi-pass printer according to claim 14, further comprising:

driving the camming mechanism via a motor.

16. A multi-pass printer comprising:

a photoreceptor device mounted on an axis;

a plurality of developers that are arranged adjacent to the photoreceptor device with each being movable between a respective first position and a respective second position;

a camming mechanism acts upon the developers to urge individual developers between the first and second positions, wherein the camming mechanism further includes:

a camming disc that is mounted to rotate about the axis, and a developer roll spacing cam having an effective radius that maintains a spacing between the plurality of developers and the photoreceptor device;

a charging device; and an exposing device.

* * * * *